US006474619B1

(12) United States Patent
Ma

(10) Patent No.: US 6,474,619 B1
(45) Date of Patent: Nov. 5, 2002

(54) TUBE GUIDE FOR A COLUMN UNIT

(75) Inventor: Dong Kwan Ma, Seoul (KR)

(73) Assignee: Samhongsa Co., Ltd., Seoul (KR)

( * ) Notice: Subject to any disclaimer, the term of this patent is extended or adjusted under 35 U.S.C. 154(b) by 0 days.

(21) Appl. No.: 09/950,069

(22) Filed: Sep. 12, 2001

(30) Foreign Application Priority Data

Jul. 24, 2001 (KR) ..... 01-44523

(51) Int. Cl.[7] ..... F16M 13/00

(52) U.S. Cl. ..... 248/631; 248/132; 248/161; 297/344.19

(58) Field of Search ..... 248/631, 132, 248/161, 404, 414, 418, 157; 297/344.19

(56) References Cited

U.S. PATENT DOCUMENTS 5,556,170 A * 9/1996 Lai et al. ..... 297/344.19 X 5,702,083 A * 12/1997 Lai ..... 248/404

* cited by examiner

*Primary Examiner*—Ramon O. Ramirez
(74) *Attorney, Agent, or Firm*—McGuireWoods LLP

(57) ABSTRACT

The present invention relates to a tube guide for a column unit, and more particularly to a tube guide for a column unit which can smoothly move a spindle upward and downward by forming a plurality of ribs on the inside surface of the tube guide which guides a spindle which has a multilateral cross-section and which can smoothly accomplish the broaching. The tube guide has a hexagonal inside surface. Two inside ribs are formed on each surface along the axial direction. Since the upward and downward movements of the spindle reduce the contacting area, the frictional force is remarkably reduced and the spindle is smoothly moved upward and downward. Further, only one surface of the inside rib needs to be broached, the broaching area is remarkably reduced.

13 Claims, 6 Drawing Sheets

TUBE GUIDE FOR A COLUMN UNIT

BACKGROUND OF THE INVENTION

1. Field of the Invention

The present invention relates to a tube guide for a column unit, and more particularly to a tube guide for a column unit which can smoothly move a spindle upward and downward by forming a plurality of ribs on the inside surface of the tube guide which guides a spindle which has a multilateral cross-section and which can easily accomplish the broaching.

2. Description of the Prior Art

A well-known column unit applied to a chair has a gas cylinder installed in the interior of a base tube. Namely, a piston rod of a gas cylinder is rotatably installed by a ball bearing to a supporter which seals the lower portion of a base tube. The piston installed at the end of the upper portion of the piston rod is located in the interior of the spindle of the gas cylinder. The interior of the spindle is filled with a pressure gas so as to act as a gas cylinder. The pressure gas in the spindle is not discharged outside even when the spindle is moved upward and downward along the piston. The spindle is separated into upper and lower portion chambers by the piston. A hole is formed in each chamber and the chambers are connected by a bypass channel. A control pin which controls the control valve and the opening/closing is installed in the hole formed in the upper chamber. A sheet of a chair is positioned at the upper portion of the spindle. A chair base which has wheels is installed at the lower portion of the base tube.

The above-mentioned column unit comprises a base tube and a gas spindle. The height of the chair seat is regulated by moving the spindle of the gas cylinder to the upper and lower portions. If the control valve is opened by pressing the control pin when the spindle is located at the lowest portion, the upper and lower chambers of the spindle is connected through the two holes and the bypass channel and the pressure gas of the spindle pushes the piston towards the lower portion of the spindle and the spindle is moved upward along the piston rod. On the contrary, if the force is applied with such a value which exceeds the pressure gas from the upper portion of the spindle, the spindle is moved downward. The height of the chair seat is regulated by regulating such an operation. Further, the cushion is felt when a user is seated on the chair seat due to the gas cylinder.

Such a column unit can be applied to a table. In case the column unit is installed in the table, the table does not need to be rotated and a non-rotating column unit is used and the tube guide has a multilateral, mainly hexagonal inside cross-section. The spindle has a multilateral outside cross-section when the spindle makes contact with the inside. In case a guide sleeve is interposed therebetween to guide the spindle and prevent the rotation of the spindle, the guide sleeve has a multilateral outside cross-section.

The tube guide which has multilateral inside cross-section is manufactured by using a plastic molding die, and the broaching is needed to smoothly move the spindle. However, the broached area is broad and the broaching cannot be easily accomplished due to curved portions.

SUMMARY OF THE INVENTION

The present invention has been made to solve the above-mentioned problem, and accordingly it is an object of the present invention to provide a tube guide for a column unit which can smoothly move a spindle upward and downward by forming a plurality of ribs on the inside surface of the tube guide which guides a spindle which has a multilateral cross-section and which can smoothly accomplish the broaching.

In order to achieve the object of the present invention, the present invention provides a tube guide for a column unit which has a multilateral inside cross-section so that the outer cross-section of the column unit can accommodate a multilateral spindle and which is inserted from the upper end portion of a base tube to a predetermined depth, wherein at least one rib which makes contact with the outer surface of the spindle along the axis direction is formed on the inside surface which has a multilateral cross-section of the tube guide.

The rib is formed at a portion except for the bent portion among the inside surfaces of the tube guide.

Two ribs are formed on each surface of the inside surface of the tube guide.

The rib is vertically protruded from the inside surface of the tube guide so that two ribs can make contact with the outer surface of the spindle.

A guide sleeve is installed at the outer surface of the spindle so that the guide sleeve is moved integrally upward and downward and the outside cross-section is multilateral so as to correspond to the cross-section of the inside of the tube guide.

The inside surface of the tube guide has a hexagonal cross-section.

The corner of the cross-section of the inside surface of the tube guide is rounded.

BRIEF DESCRIPTION OF THE DRAWINGS

The above and other objects and advantages of the present invention will become readily apparent by reference to the following detailed description when considered in conjunction with the accompanying drawings wherein.

DETAILED DESCRIPTION OF THE PREFERRED EMBODIMENT

Hereinafter, a preferred embodiment of the present invention will be explained in detail with reference to the attached drawings.

Figure 1:
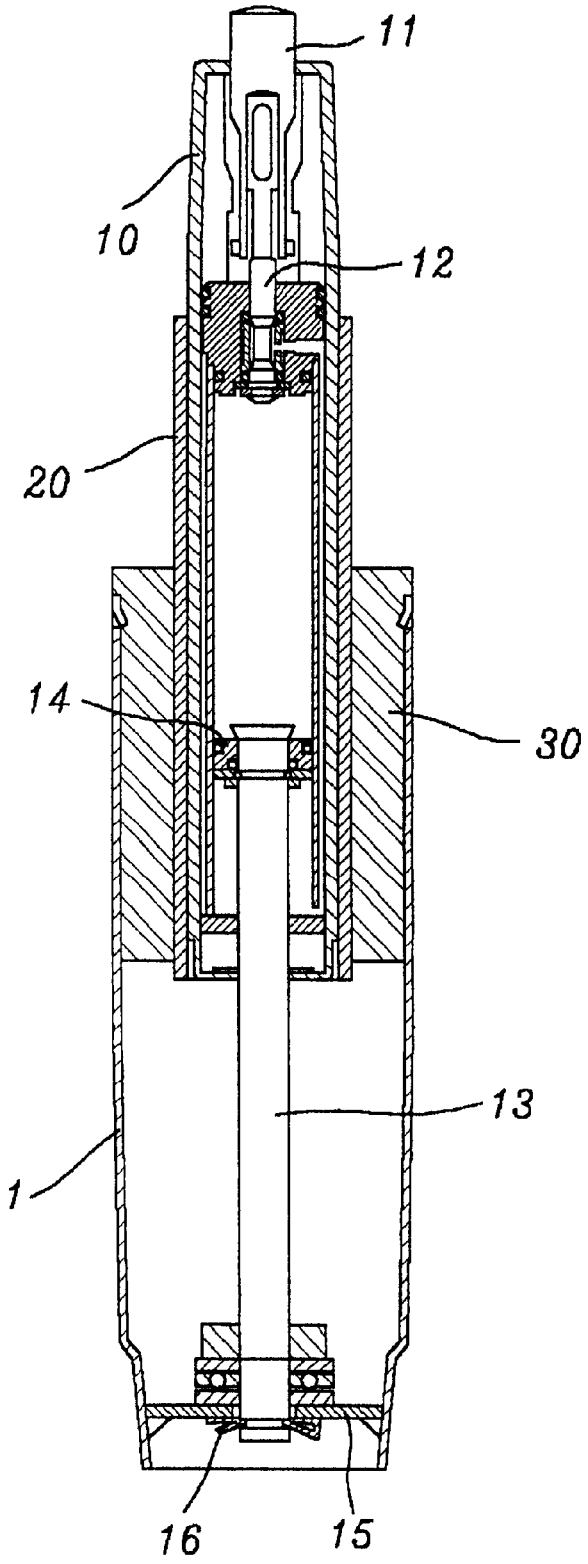
FIG. 1 is a cross-section of a column unit to which a tube guide according to the present invention is applied.

A column unit in which a tube guide 30 according to the present invention has a structure in which a spindle 10 is moved upward and downward by inserting a piston rod 13 which has a lower end portion which is engaged by a clip 16 into a supporter 15 which has a lower end portion which is welded to a hollow base tube 1 which is an outer tube as shown in FIG. 1. Such a structure is operated by using a conventional gas spring. Therefore, a piston 14 is engaged with an upper portion of a piston rod 13. A piston 14 is moved upward and downward in the interior of a cylinder of a spindle 10. Namely, if a gas opening pin 11 is pressed, a gas opening/closing pin 12 is moved downward and the upper and lower spaces of the cylinder which is divided by a piston 14 are communicated with each other and the spindle 10 is moved upward by the gas pressure of the interior of the cylinder.

A guide sleeve 20 which has a hexagonal outer cross-section is installed on the outer surface of the spindle 10, and a tube guide 30 which has a hexagonal inner cross-sectional is inserted from the upper end portion of a base tube 1 to a predetermined depth so that the spindle is guided.

Figure 2:
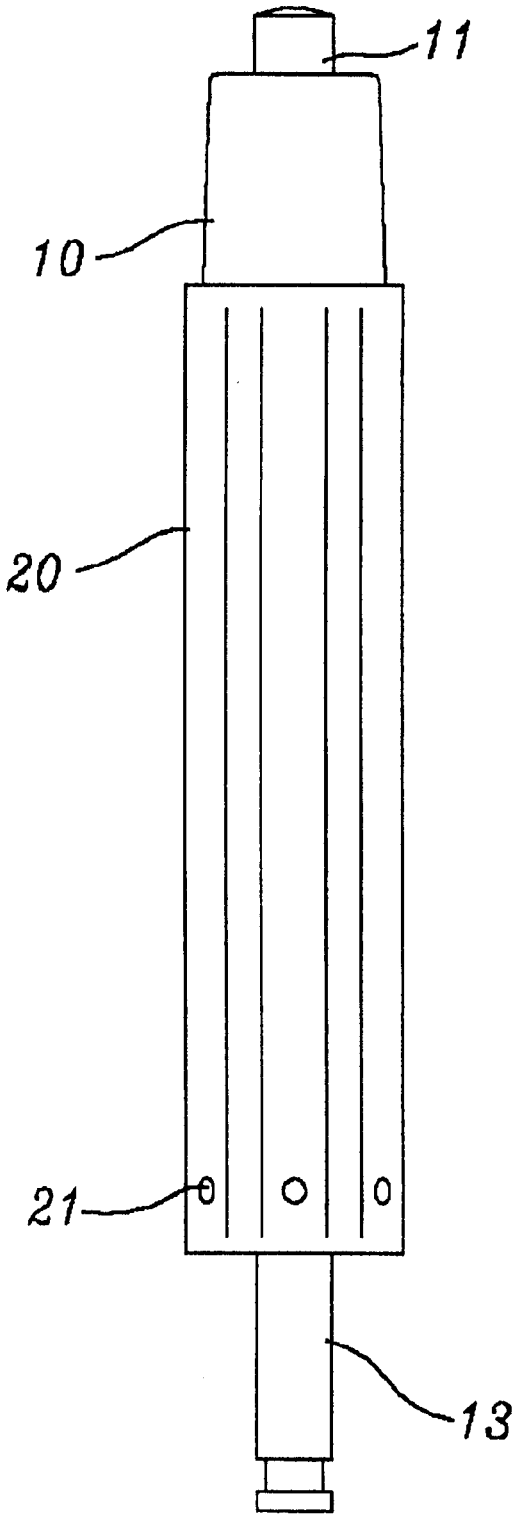
FIG. 2 is a front view of a spindle in which a guide sleeve is engaged with the outer surface.
Figure 3:
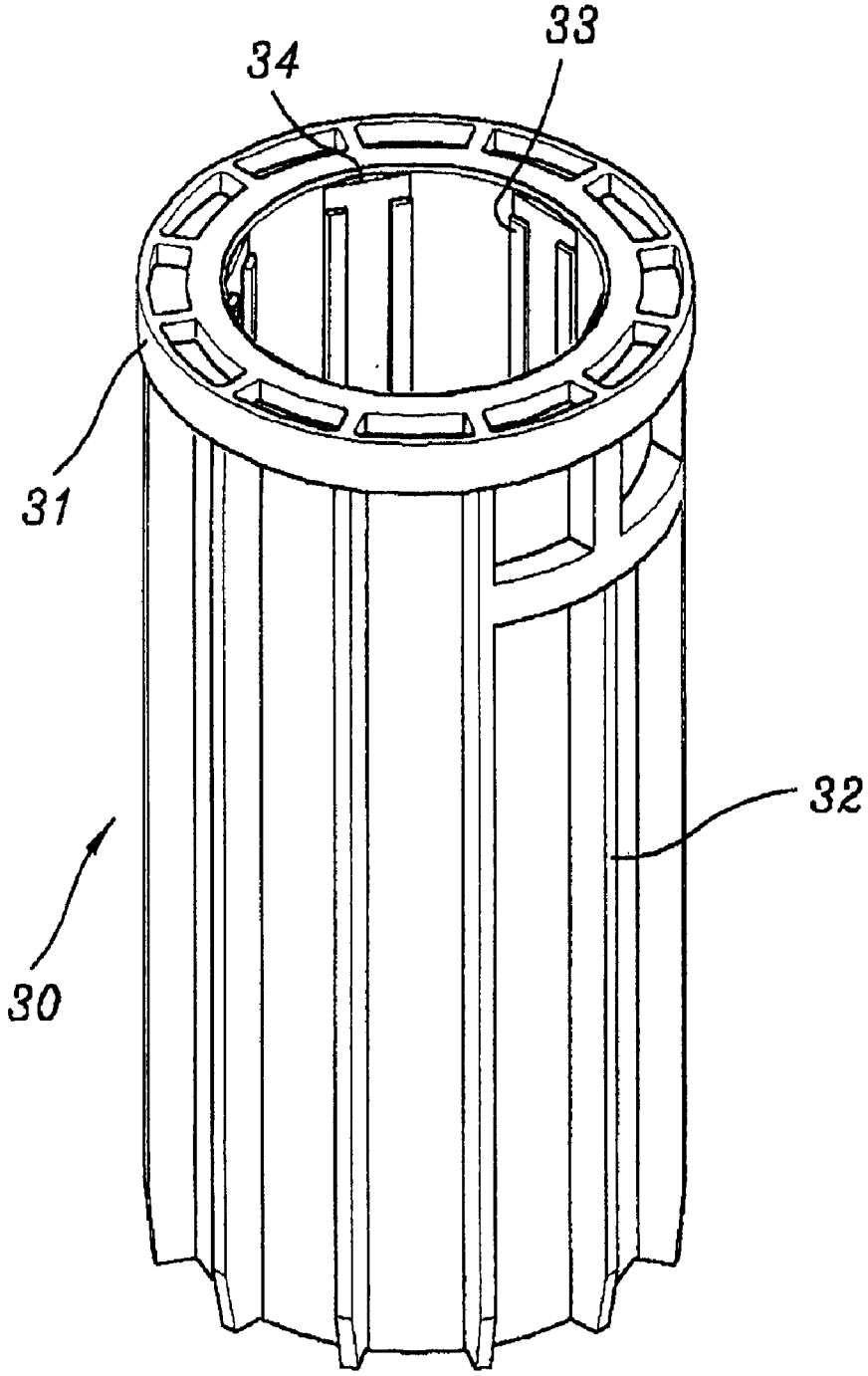
FIG. 3 is a perspective view of a tube guide according to the present invention.
Figure 4:
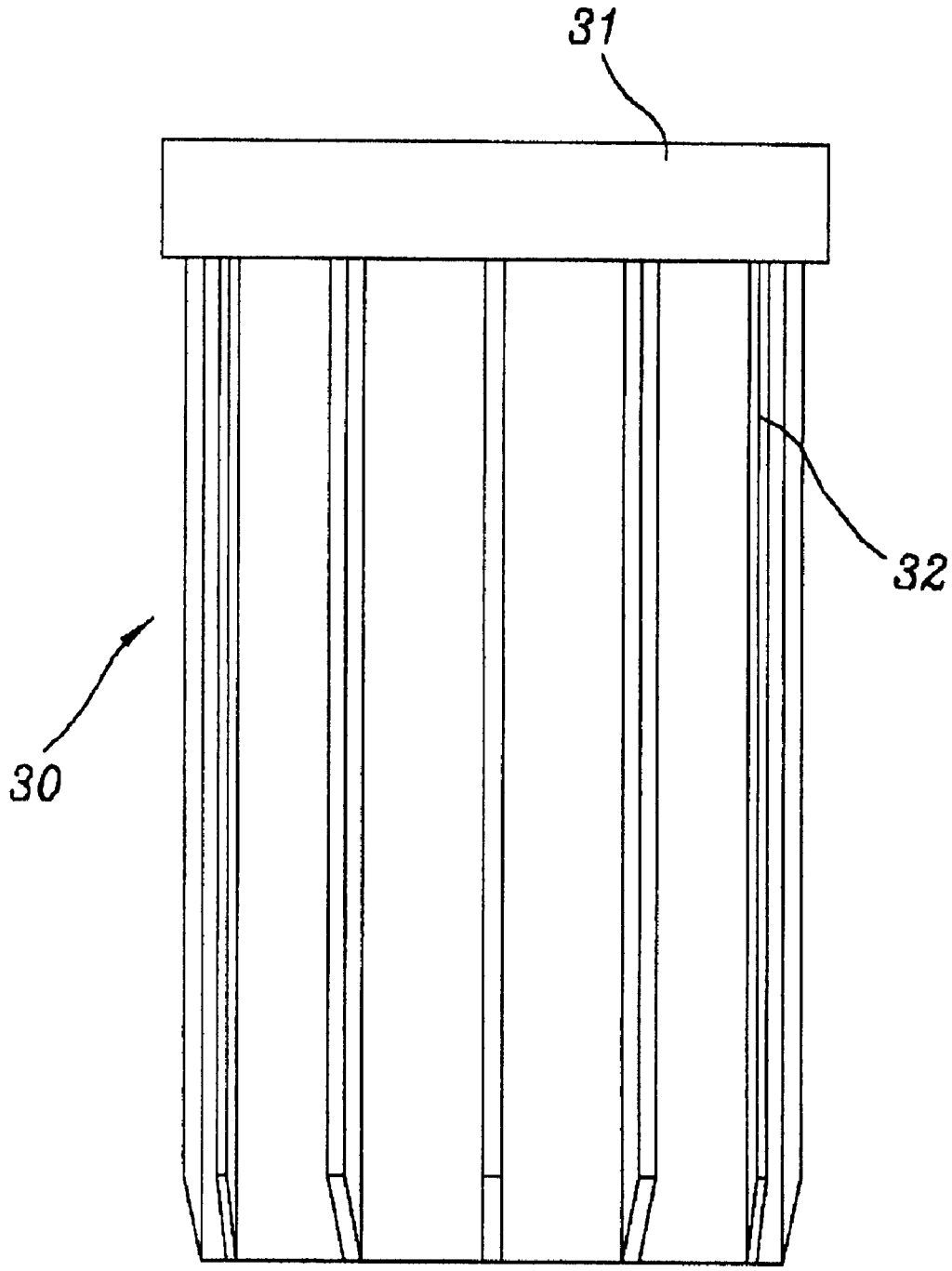
FIG. 4 is a front view of a tube guide according to the present invention.
Figure 5:
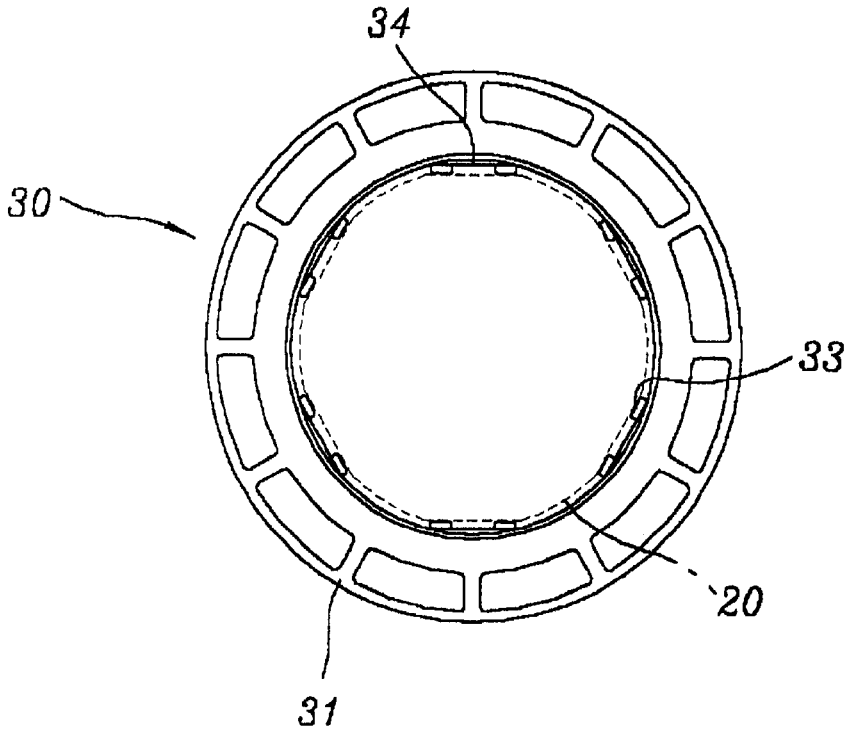
FIG. 5 is a top view of a tube guide according to the present invention.
Figure 6:
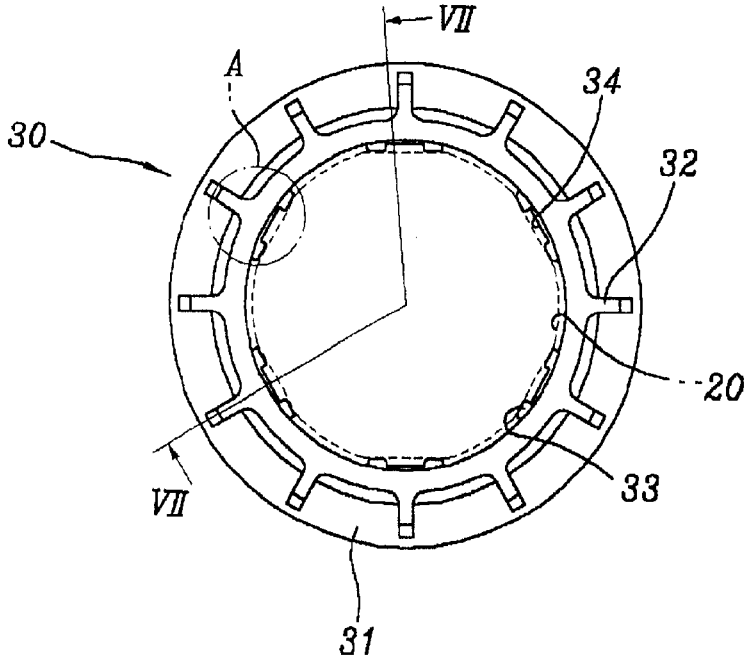
FIG. 6 is a bottom view of a tube guide according to the present invention.
Figure 7:
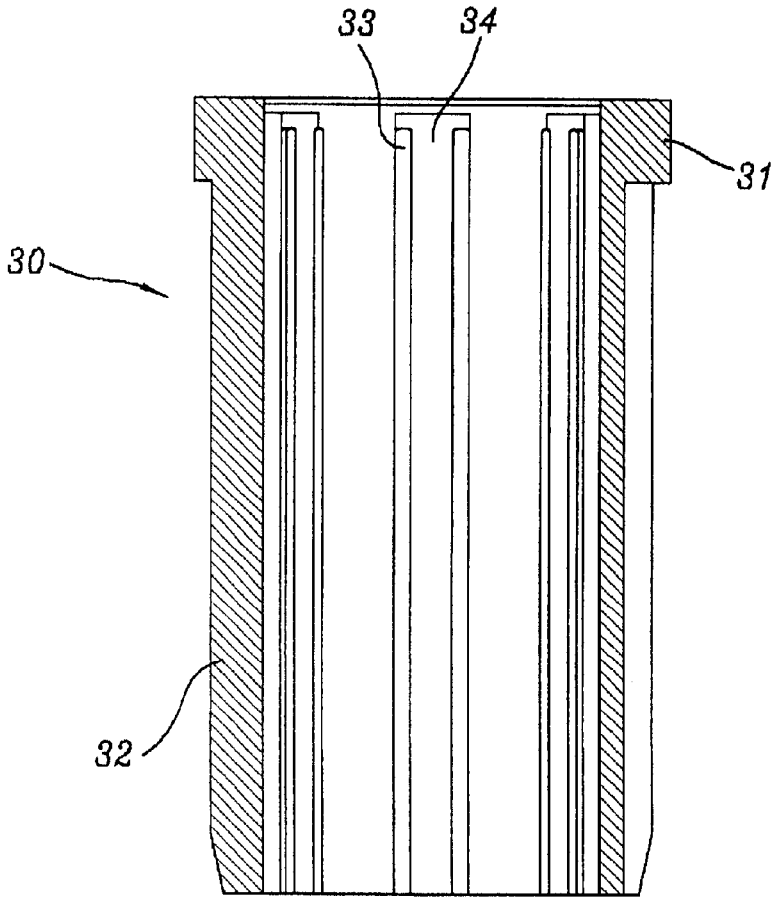
FIG. 7 is a cross-section according to line VII shown in FIG. 6.
Figure 8:
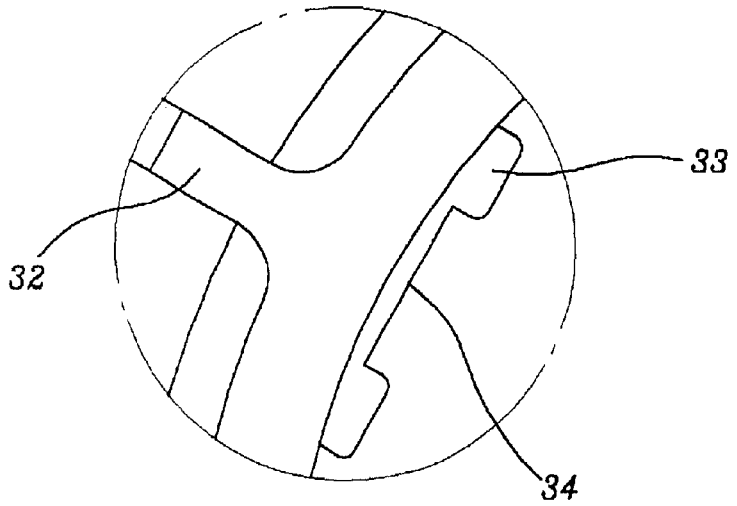
FIG. 8 is a view of portion A shown in FIG. 6.

The guide sleeve 20 is moved upward and downward integrally together with the spindle 10 by forming a pressing portion by pressing at least one predetermined portion as shown in FIG. 2. The guide sleeve 20 is not rotated but moved upward and downward when the spindle is moved upward and downward. The guide sleeve 20 is moved upward and downward together with the spindle 10. Since the guide sleeve which has a hexagonal outer surface is inserted into a tube guide 30 which has a hexagonal inside surface 34, the spindle 10 is not rotated and a column unit which is not rotated is constituted.

The column unit according to the present invention differs from a conventional column unit in that the spindle 10 is not rotated.

Especially, the tube guide 30 of the column unit according to the present invention is constituted by using a long cylindrical member as shown in FIGS. 3 to 8. The upper end portion 31 has a diameter larger than the inner diameter of a base tube 1 so that the outer surface is caught by the upper end of the base tube 1. The lower portion of the upper end portion 31 is formed such that it has a diameter which can be inserted into the inner side of the base tube. A plurality of outer rib 32 which is protruded towards the outside is radially formed about an axis.

The inside cross-section of the tube guide 30 is hexagonal so that the hexagonal guide sleeve 20 is moved upward and downward. Two inside ribs 33 which are protruded along the lengthwise direction are formed on each surface 34. The number of the inside rib 33 can be increased or decreased.

The inside rib 33 has a same height from the inside surface 34 of the tube guide 30. The protruding direction is formed such that it is perpendicular to the inside surface 34. Therefore, when the spindle 10 is moved upward and downward, the surfaces of the outside of the guide spindle 20 makes contact with the two inside ribs 33 which is formed in the surface 34 of the inside of the tube guide 30.

The six corners which is formed on the inner side of the tube guide 30 and the outside of the guide sleeve is filleted and rounded.

Since the inside rib 33 is formed in the tube guide 30, if the spindle 10 is moved upward and downward with the gas opening pin 11 pressed, the guide sleeve 20 is integrally moved upward and downward. Then, the six surfaces of the outside of the guide sleeve 20 make contact with the two inside ribs 33 when they are moved upward and downward. Therefore, the area of the inside surface of the tube guide 30 which makes contact with the outside surface of the guide sleeve 20 is remarkably reduced. Then, the spindle 10 cannot be rotated.

Since the tube guide for the column unit according to the present invention has the inside ribs on each inside surface, the contacting area is reduced and the frictional force is reduced and the upward and downward movement of the spindle is smoothly accomplished.

Further, since the tube guide for the column unit according to the present invention has a hexagonal inside surface and the inside rib is formed in each surface and only one surface of the rib makes contact with the guide sleeve, all inside surfaces of the tube guide should not be broached and the broaching is accomplished with respect to one surface of the inside rib.

As stated above, a preferred embodiment of the present invention are shown and described. Although the preferred embodiment of the present invention has been described, it is understood that the present invention should not be limited to the preferred embodiment but various changes and modifications can be made by one skilled in the art within the spirit and scope of the present invention as hereinafter claimed.

What is claimed is:

1. A tube guide for a column unit comprising a multilateral inside cross-section so that the inside cross-section of the tube guide can accommodate a guide sleeve having a multilateral corresponding outside cross-section, and which is inserted from an upper end portion of a base tube to a predetermined depth, wherein at least one rib on an inside surface of the tube guide makes contact with an outer surface of the guide sleeve along the axis direction.

2. A tube guide for a column unit according to claim 1, wherein the rib is formed at a portion except for a bent portion among the inside surfaces of the tube guide.

3. A tube guide for a column unit according to claim 1, wherein two ribs are formed on each surface of the inside surface of the tube guide.

4. A tube guide for a column unit according to claim 3, wherein the rib is vertically protruded from the inside surface of the tube guide so that two ribs can make contact with the outer surface of the guide sleeve.

5. A tube guide for a column unit according to claim 1, wherein the guide sleeve is installed at the outer surface of the spindle so that the guide sleeve is moved integrally upward and downward and the outside cross-section is multilateral so as to correspond to the cross-section of the inside of the tube guide.

6. A tube guide for a column unit according to claim 1, wherein the inside surface of the tube guide has a hexagonal cross-section.

7. A tube guide for a column unit according to claim 6, wherein the corner of the cross-section of the inside surface of the tube guide is rounded.

8. A column unit, comprising:

a hollow base unit:

a guide tube inserted within the hollow base unit, the guide tube having an inner surface comprising a plurality of vertically extending, adjacent inner wall surfaces;

a guide sleeve insertable within the guide tube, the guide sleeve having an outer surface with plurality of vertically extending, adjacent outer wall surfaces, the vertically extending, adjacent outer wall surfaces corresponding substantially with the vertically extending, adjacent inner wall surfaces of the guide tube; and at least one rib extending vertically along at least one of the plurality of vertically extending, adjacent inner wall surfaces of the guide tube.

9. The column unit of claim 8, wherein the at least one rib is two ribs extending along the at least one of the plurality of vertically extending, adjacent inner wall surfaces of the guide tube.

10. The column unit of claim 9, wherein the at least one rib is two ribs extending vertically along each of the plurality of vertically extending, adjacent inner wall surfaces of the guide tube.

11. The column unit of claim 8, wherein the plurality of vertically extending, adjacent inner wall surfaces and outer wall surfaces are hexagonal shaped.

12. The column unit of claim 11, wherein a corner between each of the vertically extending, adjacent inner wall surfaces and outer wall surfaces are rounded.

13. The column unit of claim 8, wherein a corner between each of the vertically extending, adjacent inner wall surfaces and outer wall surfaces are rounded.

* * * * *